United States Patent [19]

Merz et al.

[11] 3,962,712

[45] June 8, 1976

[54] APPARATUS FOR TRANSPORTING STRIP-SHAPED OR SHEET-SHAPED MATERIALS

[75] Inventors: Werner Merz, Oberelchingen; Werner Michaelis, Stuttgart, both of Germany

[73] Assignee: Merz & Co., Oberelchingen, Germany

[22] Filed: Oct. 16, 1974

[21] Appl. No.: 515,423

[30] Foreign Application Priority Data

Oct. 17, 1973 Germany ..... 2352069

[52] U.S. Cl. ..... 354/319; 198/218; 198/219; 354/315

[51] Int. Cl.[2] ..... G03D 3/08

[58] Field of Search ..... 354/297, 319, 320, 321, 354/324, 338, 340, 315; 271/267; 198/218, 219; 226/158, 160, 168

[56] References Cited

UNITED STATES PATENTS

| | | | |
|---|---|---|---|
| 1,842,890 | 1/1932 | Williams | 198/219 X |
| 2,791,338 | 5/1957 | De Saint-Andre | 198/219 X |

FOREIGN PATENTS OR APPLICATIONS

| | | | |
|---|---|---|---|
| 1,576,820 | 8/1969 | France | 354/297 |
| 1,149,854 | 4/1969 | United Kingdom | 198/219 |
| 366,293 | 2/1932 | United Kingdom | 198/218 |

*Primary Examiner*—R. L. Moses
*Attorney, Agent, or Firm*—Michael J. Striker

[57] ABSTRACT

A plurality of strip-shaped material-engaging elements is moved by cranks in a path in which the elements sequentially move towards the material to be transported, engage it, move with it through a predetermined distance, and then release it and recede from the material.

21 Claims, 11 Drawing Figures

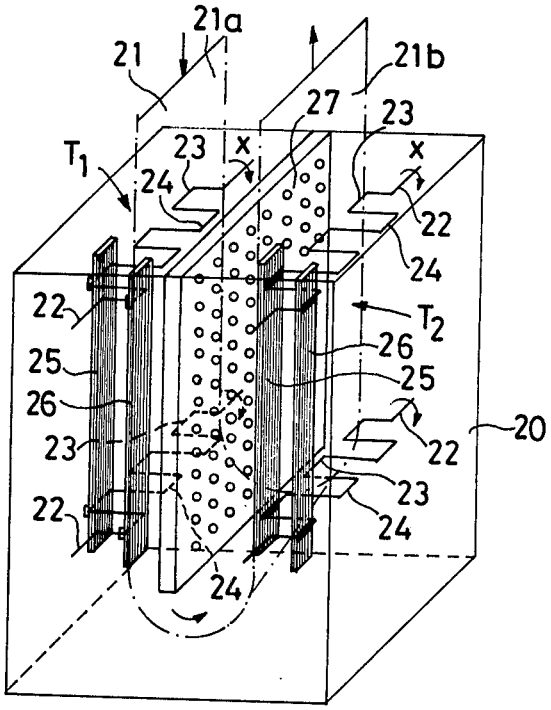
FIG.1
FIG.2 FIG.3 FIG.4 FIG.5 FIG.6
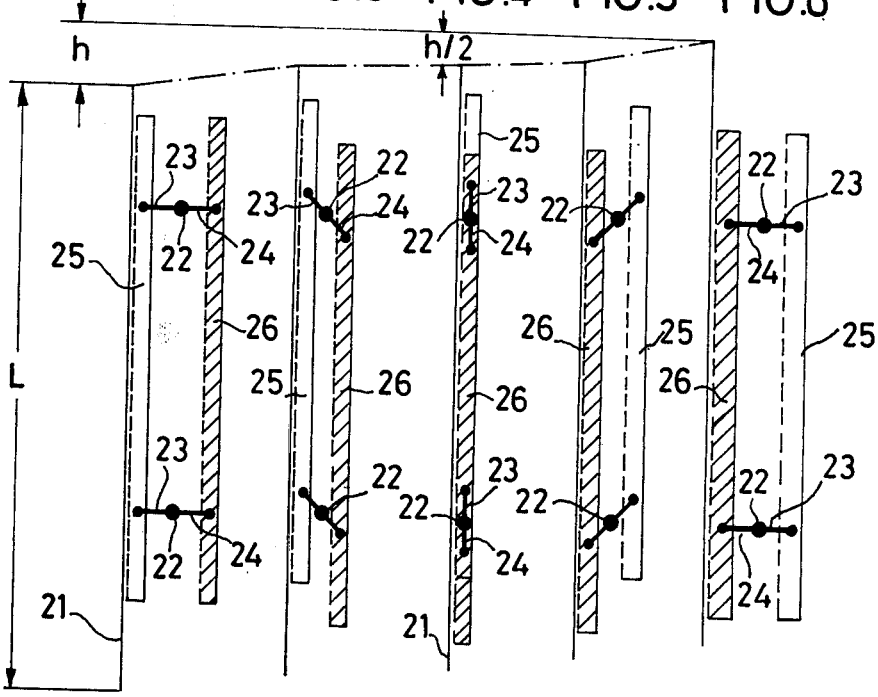

21'
21
22
T1
25
x
26
27
y1
y1
to source of suction
y2
26a
25a
22
27a
20
21
21'
22
T2
25
26
x
22
y2''
24
21
22
23
T0
y1'
y1'
25
26
22
20
28
28
y2'
33
34
34
21
26
25 a25
a26
a26'
a25'
30
29

32
31
25b
21
x
25a
23b
23a
22
23c
25c

APPARATUS FOR TRANSPORTING STRIP-SHAPED OR SHEET-SHAPED MATERIALS

BACKGROUND OF THE INVENTION

The present invention relates to a transporting apparatus in general, and more particularly to an apparatus for transporting strip-shaped or sheet-shaped materials. Still more particularly, the invention relates to such an apparatus which is usable with particular advantage for transporting photographic emulsion carriers through a treatment bath, for example a bath of developer, a bath of fixative or the like.

Various types of apparatus are known for transporting strip-shaped or sheet-shaped materials, and in particular for transporting photographic emulsion carriers. Because of the particular advantage of using the present invention in the transportation of a photographic emulsion carrier, the invention will be discussed hereafter with respect to such an application, although it should be understood that it is not limited thereto.

In the prior art, photographic emulsion carriers are either transported by rollers, endless belts, drag chains or in basket-like containers, to be treated during such transportation by one of the several treating fluids that are required to come in contact with such emulsion carriers. These prior-art apparatus all are quite complicated in construction, but are nevertheless not capable of preventing with complete reliability any damage to the highly sensitive emulsion side of the material which they transport.

SUMMARY OF THE INVENTION

Accordingly, it is an object of this invention to overcome the disadvantages of the prior art.

More particularly, it is an object of the present invention to provide an improved apparatus for transporting strip-shaped or sheet-shaped materials, which eliminates the aforementioned disadvantages.

Another object of the invention is to provide such an apparatus which is especially suitable for transporting photographic emulsion carriers and which will cause no damage to the emulsion layer or layers thereon.

Another object of the invention is to provide such an apparatus which is capable of transporting such emulsion carriers without damage to the emulsion, even though emulsion or other layers may be provided not only on one side of the carrier but on both sides, for instance a photographic emulsion on one side and an antihalation backing on the other side.

In keeping with these objects, and with others which will become apparent hereafter, one feature of the invention resides in an apparatus for transporting strip-shaped or sheet-shaped material, especially photographic material, which comprises first means including a plurality of material-engaging elements, and second means which serves for moving the elements sequentially in paths in each of which the respective element moves into engagement with the material, transports the material through a predetermined distance, and then moves out of engagement with the material.

According to the invention, the second means utilizes crank devices, which term is intended to designate any type of a device capable of affording a crank-like action in respect to the movement of the material engaging elements and hence of the movement of the material itself.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a diagrammatic perspective view of an embodiment of the invention, in a somewhat simplified illustration;

FIGS. 2–6 are diagrammatic views, illustrating the movements of one of the components shown in FIG. 1;

DESCRIPTION OF THE PREFERRED EMBODIMENTS

Figures 7, 8, 9, 10, 11:
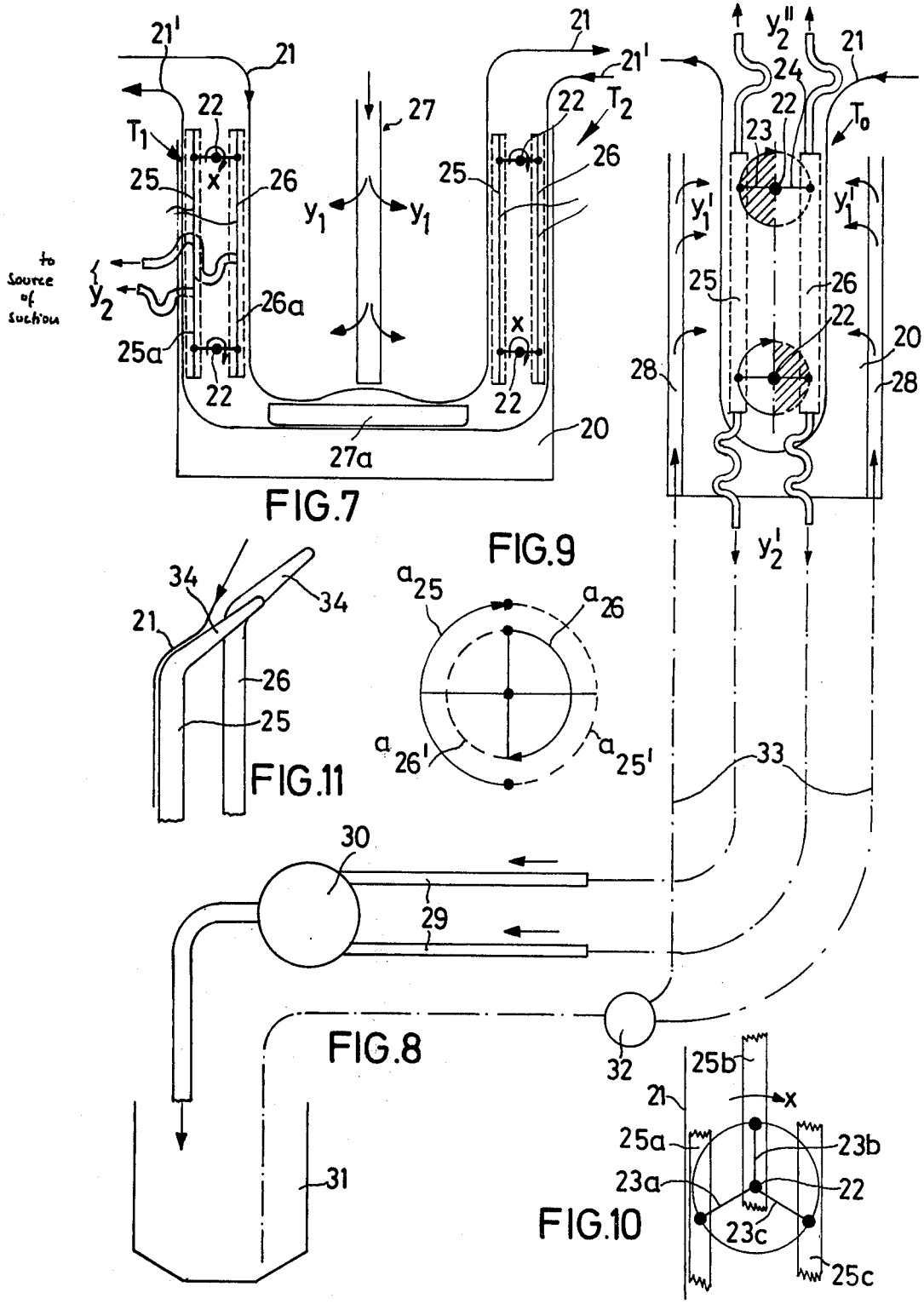
FIG. 7 is a diagrammatic end view of a further embodiment of the invention.
FIG. 8 is a diagrammatic fragmentary section, illustrating another embodiment of the invention.
FIG. 9 is a diagrammatic top-plan view of a detail of a further embodiment of the invention.
FIG. 10 is a diagrammatic fragmentary detail view of a further embodiment of the invention.
FIG. 11 is a view illustrating still another detail of the invention in fragmentary form.

Referring now firstly to FIG. 1 it will be seen that reference numeral 20 identifies a diagrammatically illustrated housing or tank through which material 21, here illustrated in form of an elongated strip, is to travel in the indicated direction (see the arrows) in a substantially U-shaped path. The material 21 has a downwardly extending leg portion 21*a* that travels downwardly at the left side of FIG. 1, and an upwardly extending leg portion 21*b* which travels upwardly at the right side of FIG. 1. It should be understood that it is not necessary for the material 21 to be strip shaped, as it could also be in form of individual sheets or the like. The tank 20 may be filled with a bath of treating liquid, for example with the developer liquid.

The transportation of the material 21 through the tank 20 is effected by two transport units $T_1$ and $T_2$ which are mounted in the tank 20 and which each have two crank shafts 22. There are thus provided four crank shafts 22 all of which are arranged for rotation in mutual parallelism. The two crank shafts of each unit $T_1$ and $T_2$ are located vertically spaced from one another. The end portions of the crank shafts are journalled in suitable manner in or on the tank 20, and the journalling is conventional and therefore requires no detailed discussion. Each of the crank shafts 22 is provided with a plurality of cranks 23, 24 which alternately extend to one and to the opposite side of the crank shaft, i.e. in FIG. 1 the cranks 23 extend to the left and the cranks 24 extend to the right. For the sake of explanation it should be understood that all of the crank shafts 22 rotate in one and the same direction, as indicated by the arrows X.

The cranks 23 of each set of vertically spaced crank shafts 22 jointly carry a substantially strip-shaped material-engaging or transporting element 25; the cranks 24 of the same vertically spaced crank shafts jointly carry a similar element 26. In FIG. 1 the arrangement is such that the elements 25 are of the left unit $T_1$ located at the inner sides of the cranks 23 whereas the elements 26 of the same unit $T_1$ are located at the outer sides of the cranks 24, whereas the arrangement is reversed for the elements and cranks of the unit $T_2$. This explanation is of course made with reference to the particular position that has been illustrated for the elements and the cranks in FIG. 1.

The material 21 extends outwardly past the units $T_1$ and $T_2$ so that, when the apparatus is in the position shown in FIG. 1, it passes outwardly adjacent the elements 26 of the unit $T_2$ and outwardly adjacent the elements 25 of the unit $T_1$.

Located midway between the units $T_1$ and $T_2$ in the tank 20 is a supply for a treating liquid; this supply is here in form of a hollow plate-shaped body 27 the opposite sides of which are perforated as illustrated and around whose lower edge the material 21 makes a bend resembling the bight of a U. The treating liquid is admitted into the interior of the body 27 and issues from the perforations of the same. The elements 25 and 26 are themselves hollow and formed with perforations (not shown in FIG. 1) so that the treating liquid can enter into the interior of the elements 25, 26 from which it is subsequently removed again in a manner still to be discussed later on. This arrangement assures that there is a constant stream of treating fluid from the body 27 into the interior of the elements 25, 26, and this constant flow of fluid into the elements 25, 26 exerts a suction effect upon the material 21 so that, when the elements 25, 26 come close enough to the legs 21*a*, 21*b*, the suction effect of the liquid flowing into the interior of the elements 25, 26 will draw the material 21 against these and hold it in engagement with the elements.

When the crank shafts 22 are turned in the direction of the arrow X, for example by a non-illustrated drive such as a gear drive, the elements 25, 26 are alternately moved against the material 21 which adheres to them due to the aforementioned suction, and then as they move along during further rotation of the crank shafts 22 they will transport the material 21 in the direction of the arrows, that is they will draw it down at the left-hand side and will move it up at the righthand side of FIG. 1. The operation is of course such that the elements 25, 26 of each of the units $T_1$ and $T_2$ are alternately moved into and out of engagement with the respectively associated leg of the material 21, that is the leg 21*a* for the unit $T_1$ and the leg 21*b* for the unit $T_2$.

FIGS. 2–6 diagrammatically illustrate the manner in which the advancement of the material 21 takes place. The illustration is for the unit $T_2$ which is shown at the right-hand side of FIG. 1, it being understood that the operation is analogous for the unit $T_1$. For clarity of illustration, FIGS. 2–6 show the element 26 transversely shaded while the element 25 is not shaded. The perforated sides of the elements 25, 26 are shown in broken lines.

FIG. 2 illustrates a portion of the material 21, having the length L and being supported by the element 25 due to the earlier-mentioned suction effect. When the elements 25 and 26 are in the position shown in FIG. 2, they have the greatest mutual spacing from one another which they can assume.

FIG. 3 shows the next position in which the crank shafts 22 have been turned through 45° from the position in FIG. 2; FIG. 4 shows the position in which the crank shafts 22 have been turned through 90° from FIG. 2; FIG. 5 shows the position in which the crank shafts 22 have been turned through 135° from the position in FIG. 2; and FIG. 6 shows the position in which the crank shafts 22 have been turned through 180° with reference to FIG. 2. It is clear from a comparison of FIGS. 2–6 that the elements 25 and 26 will approach one another until when they have reached the position of FIG. 4 they will be in alignment with one another. When they are in this position the element which moves towards the left, namely the element 26 in this case, takes over the engagement of the material 21 from the element 25 and lifts it away from the latter. During the movement of the crank shafts 22 from the position of FIG. 2 to the position of FIG. 4 the material 21 has been advanced in upward direction through the distance $h/2$, that is through a stroke h which corresponds to the crank radius of the crank 23.

During the further movement of the crank shafts 22 and the elements 25, 26 from the position of FIG. 4 to the position of FIG. 5 and finally to the position of FIG. 6, the material 21 is moved through a further stroke $h/2$, so that after the crank shafts have turned through 180° from the position in FIG. 2 the material 21 will have been advanced (in this instance in upward direction) through a stroke $h$ which corresponds to double the radius of the cranks 23 and 24.

Coming now to the embodiment illustrated in FIG. 7 it will be seen that this corresponds in principle to the one in FIG. 1, but that in FIG. 7 the elements 25, 26 serve at both sides for the transportation of strip material 21 and 21′, and that they are therefore provided at both sides with perforations to permit holding the material by way of suction against the respective elements 25, 26.

In the embodiment of FIG. 7 the turning of the crank shafts 22 again results in the same alternate engagement and disengagement of the elements 25, 26 of the units $T_1$ and $T_2$ from the material to be transported. However, in this case there is alternate engagement with the strip materials 21 and 21′, and whereas the strip material 21 is being transported downwardly by the unit $T_1$ and upwardly by the unit $T_2$, the strip material 21′ is being transported downwardly by the unit $T_2$ and upwardly by the unit $T_1$. This is clearly visible in FIG. 7. In other words, the strip materials 21 and 21′ are at one and the same time being transported in mutually opposite directions so that the units $T_1$ and $T_2$ are capable of simultaneously not only transporting two strip materials, but transporting them in mutually opposite directions as mentioned.

The direction of rotation of the crank shafts 22 is again identified with reference character X and it will be seen that starting with the illustrated position, the element 25 of the unit $T_1$ transports the material 21′ upwardly whereas at the same time the element 26 of the unit $T_1$ transports the material 21 downwardly. Concomitantly, the element 25 of the unit $T_2$ transports the material 21 upwardly while at the same time the element 26 of the unit $T_2$ transports the material 21′ downwardly. After the crank shafts 22 have turned through 90° in the direction of the arrows X, a reversal takes place in that now the element 25 of unit $T_1$ engages and moves downwardly the material 21 and the element 26 of unit $T_1$ engages and moves upwardly the material 21. A similar reversal takes place with respect to the elements 25 and 26 of the unit $T_2$.

In FIG. 2 the treating liquid is again admitted through the hollow body 27 and is located intermediate the units $T_1$ and $T_2$ and issues in the direction of the arrows $y_1$ into the interior of the tank 20, to enter through the perforations in the elements 25, 26 into the interior of the latter. It is diagrammatically illustrated that the interiors of the elements 25, 26 communicate with hoses or the like, which can be connected to a source of suction so that the liquid entering the interior of the elements 25, 26 is withdrawn through these hoses in the direction of the arrows $y_2$.

A guide element 27 is provided which guides the materials 21, 21' in the region intermediate the units $T_1$ and $T_2$. The illustrated guide bar 27*a* could of course be supplemented by or replaced with a different guide arrangement or a transporting arrangement analogous to the units $T_1$ or $T_2$, or by roller guides or the like.

Because each of the units $T_1$ and $T_2$ in FIG. 7 transports two of the materials, namely the materials 21 and 21', the interiors of the elements 25, 26 are advantageously subdivided into two discrete compartments by respective partitions 25*a* or 26*a*, and these compartments advantageously can be separately connected with the suction source or with separate suction sources. Of course, each of the cranks could be separately provided with two elements 25 or two elements 26, if the partitions 25*a* and 26*a* are not desired.

The embodiment illustrated in FIG. 8 shows that a single transporting unit, here designated with reference character $T_0$ can also be employed. It again has the elements 25 and 26 which serve for transportation of only a single strip of material 21, or a single stream of sheets analogous to the material 21. In FIG. 8, the material 21 is just being transferred from the right-hand side of the element 26 to the left-hand side of the element 25, whereas for example after a rotation of the crank shafts 22 through 180° the same material 21 is transported downwardly by the right-hand side of the element 25 and upwardly by the left-hand side of the element 26. The two legs of the material 21 which are thus formed approach and recede from one another relatively strongly in keeping with the rotation of the crank shaft, so that appropriate measures must be taken in the region where the strip material 21 is reversed to form the bight of the U.

It is advantageous in the embodiment of FIG. 8 to admit the treating liquid via lateral inlet chambers 21*a* having interrupted walls and which are located at opposite sides of the unit $T_0$. The withdrawal may be laterally, as indicated in FIG. 7, or as indicated by the yieldable hose connections shown in FIG. 8, it can be carried out at the bottom in the direction of the arrow $y_2'$, or at the top in the direction of the arrow $y_2''$; the latter possibility is believed to be the most advantageous because it provides the least possible interference with the guidance of the material 21.

FIG. 8 indicates diagrammatically in connection with the removal of the treating liquid in the direction of the arrow $y_2'$ that the liquid can be withdrawn via hoses or conduits 29 that are connected with a pump 30, and can for instance be returned to a reservoir 31 from which it is withdrawn by a pump 32 and returned to the inlet chambers 28 via conduits 33. However, as a general rule a single pump could be used to circulate the liquid in a closed circuit and without any need for the reservoir 31.

For economic reasons it is advantageous to reduce the suction in the elements 25 and 26 when these do not at a given moment transport the material 21 or 21'. For example, this would be true in FIGS. 2–6 of the element 26 when the same is in the positions which it assumes in FIGS. 2, 3 and 4, and for the element 25 when the same is in the position which it assumes in FIGS. 4, 5 and 6. Such a possibility is illustrated in FIG. 9 in a highly diagrammatic form. The solid-line arcuate portions $a_{25}$ and $a_{26}$ indicates the region in which the interior of the elements 25 and 26 is subjected to full suction, whereas the broken-line arcuate portions $a_{25}'$ and $a_{26}'$ indicate the regions where the suction in the interior of the elements 25, 26 is reduced. FIG. 9 illustrates one complete revolution of a crank shaft 22. The reduction of the suction, for example to approximately one-third of the full suction, may be effected by periodically controlled throttles in the conduits 33, or in any other suitable manner.

FIG. 10 indicates that the crank shafts 22 need not have only two sets of cranks 23 and 24 which are located oppositely one another, but could also have three or more circumferentially distributed cranks, as indicated with respect to the cranks 23*a*, 23*b* and 23*c*. Each of these cranks has pivoted to it one of the elements 25*a*, 25*b* or 25*c* which correspond to the element 25 of the preceding embodiments, and which periodically transfer the material 21 from one to another after each 120° rotation of the crank shaft 22. The arrangement in FIG. 10 has the advantage that the lateral stroke through which the material 21 or 21' is transported in direction transversely to its advancement, will be the smaller the greater the number of cranks that is present.

FIG. 11 shows that the elements 25, 26 may be provided at least at one end with an inclined or bent portion 34 which advantageously is arcuately rounded where it joins with the remainder of the elements 25, 26. It is at these ends that the material 21 (or 21') can slide over the arcuately rounded portion onto the inclined or bent portion 34, or off the same onto the remainder of the element 25, 26, and will thus be subject to very gentle treatment.

It will be appreciated that it is of course also possible to alternately transport strip-shaped and sheet-shaped materials, or in the case of the type of unit as for instance shown in FIG. 7, which is capable of transporting two materials simultaneously, to have it transport a strip-shaped material and a stream of sheet-shaped materials at one and the same time. The sheet-shaped materials could also be supplied on a separate belt if desired, that is they could be suitably secured to the belt and the belt itself could be transported by the disclosed apparatus, but a direct transport is usually more advantageous and simpler. A single source of suction or separate source of suction could be provided for the elements 25, 26 or analogous elements, and the supply and removal of treating liquid could also be carried out in the manner different from what has been illustrated in the drawing.

It will be understood that each of the elements described above, or two or more together, may also find a useful application in other types of constructions differing from the types described above.

While the invention has been illustrated and described as embodied in an apparatus for transporting strip-shaped or sheet-shaped materials, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An apparatus for transporting strip-shaped or sheet-shaped materials, especially photographic material, comprising first means including a plurality of hollow material-engaging elements having respective material-engaging surfaces which are perforate, and suction means communicating with the interior of the elements; and second means for moving said elements sequentially in paths in each of which the respective element moves into engagement with the material, transports the material through a predetermined distance, and then moves out of engagement with the material.

2. An apparatus as defined in claim 1, wherein said engaging elements are strip-shaped, and said second means comprises crank drive means which are offset relative to one another and which transmit motion to said engaging elements.

3. An apparatus as defined in claim 1, wherein said suction means alternately applies greater and lesser suction to the interior of said elements.

4. An apparatus as defined in claim 3, wherein said suction means comprises a suction source, and throttling means interposed between said source and the respective elements.

5. An apparatus as defined in claim 1; and further comprising means for supplying a treating fluid to said material exteriorly of said elements, said treating fluid being drawn by said suction means into the interior of said elements for subsequent discharge therefrom.

6. An apparatus as defined in claim 5, wherein said elements are arranged in two transversely spaced groups; and wherein said supplying means comprises a supply conduit which discharges said treating fluid under pressure intermediate said groups.

7. An apparatus as defined in claim 5, said elements being arranged in a group which forms a row; and wherein said supply means comprises supplying elements which supply said treating fluid under pressure at opposite sides of said row.

8. An apparatus as defined in claim 7, wherein said supplying elements are discontinuous walls.

9. An apparatus as defined in claim 1, wherein the interior of said elements is subdivided into two discrete compartments.

10. An apparatus for transporting strip-shaped or sheet-shaped materials, especially photographic material, comprising means for engaging the material to be transported and including a plurality of engaging elements each having an engaging surface, and means for generating suction at each respective engaging surface during a predetermined time period to thereby engage the material with said respective engaging surface; and means for moving said engaging elements in paths in which each respective engaging element moves into engagement with the material, transports the material through a predetermined distance during said period, and then moves out of engagement with the material.

11. An apparatus as defined in claim 10, wherein said engaging elements are strup-shaped, and said moving means comprises crank drive means which are offset relative to one another and which transmit motion to said engaging elements.

12. An apparatus as defined in claim 10, wherein said engaging elements are hollow and said respective material-engaging surfaces are perforate; and said suction means communicating with the interior of said elements.

13. An apparatus as defined in claim 11, wherein said crank drive means comprises a crank shaft and a plurality of circumferentially distributed cranks.

14. An apparatus as defined in claim 11, wherein said crank drive means comprises two crank shafts which are spaced from one another in the direction in which said material is to be transported; and further comprising mounting means journalling said elements on said crank shafts.

15. An apparatus as defined in claim 11, wherein said elements are arranged in two groups which are spaced in the transporting direction of said material.

16. An apparatus as defined in claim 15, wherein said groups are arranged in two transversely spaced parallel rows, and said material travels in a substantially U-shaped path about said groups.

17. An apparatus as defined in claim 16; and further comprising guide means for guiding said material from one to the other of said groups.

18. An apparatus as defined in claim 11, wherein said crank drive means comprises crank shafts; and wherein each of said crank shafts carries a first group of said elements for transporting material in a first direction, and a second group of said elements for transporting material in an opposite second direction.

19. An apparatus as defined in claim 18; and further comprising deflecting means for deflecting said material from said first group to said second group of elements.

20. An apparatus as defined in claim 10, wherein each of said elements has spaced ends at least one of which is formed with a bend.

21. An apparatus as defined in claim 1, wherein said elements have opposite ends; and wherein said suction means comprises a suction source, and hoses connecting at least one end of each element to said source.

* * * * *